United States Patent [19]

Munroe

[11] 4,240,358

[45] Dec. 23, 1980

[54] WOOD PALLET

[76] Inventor: Thomas Munroe, P.O. Box 538, Far Hills Branch, Dayton, Ohio 45419

[21] Appl. No.: 770,422

[22] Filed: Feb. 22, 1977

[51] Int. Cl.[3] ..... B65D 19/26

[52] U.S. Cl. ..... 108/51.1; 108/57.1

[58] Field of Search ..... 108/51.1, 56.1, 56.3, 108/52.1, 57.1, 53.1, 53.3-55.5; 206/386, 596, 598-600; 217/43 R, 43 A; 52/592, 593, 666, 668, 669

[56] References Cited

U.S. PATENT DOCUMENTS

| | | | |
|---|---|---|---|
| 1,777,694 | 10/1930 | Halteman | 108/52.1 X |
| 2,371,106 | 3/1945 | Lewis et al. | 108/57.1 |
| 2,982,507 | 5/1961 | Woodward | 108/57.1 |
| 3,148,637 | 9/1964 | Lund | 108/53.1 |
| 3,192,883 | 7/1965 | Massengale | 108/56.1 |
| 3,204,583 | 9/1965 | Nicholson | 108/51.1 |
| 3,207,096 | 9/1965 | Munroe | 108/51.1 |
| 3,212,462 | 10/1965 | Pasquier | 108/57.1 X |

FOREIGN PATENT DOCUMENTS

| | | | |
|---|---|---|---|
| 1189367 | 10/1959 | France | 108/51.1 |
| 699130 | 10/1953 | United Kingdom | 108/51.1 |

*Primary Examiner*—William E. Lyddane

*Attorney, Agent, or Firm*—Biebel, French & Nauman

[57] ABSTRACT

A wood pallet includes a top deck, a bottom deck and spacer members. The top deck includes a pair of end members, a pair of side members, and a plurality of intermediate load supporting members. The side members include means forming inwardly facing recesses for receiving the end members, the recesses including end facing abutments to engage the inside edge of the end members so that inwardly directed forces are transmitted into and partially absorbed by the side members. The end members include beveled ends which are received against complementary beveled surfaces within the recesses to assist in securing the end members to the pallet. The bottom deck is provided with a relatively large surface area, but with openings to accommodate the wheels of a hand transport. The top and bottom decks are separated by means of spacer members including longitudinally extending stringers on which are mounted blocks of plywood. Nine plywood blocks are installed at the corners of the pallet and intermediately of the end and side members to provide an eight-way access to the pallet by the tongs of a fork lift. Corrugated fasteners are used to assemble both the top and bottom decks, the corrugated fasteners being installed on the interior surfaces of both decks.

3 Claims, 18 Drawing Figures

WOOD PALLET

BACKGROUND OF THE INVENTION

This invention relates to a wood pallet, and more specifically, to a pallet using improved construction techniques.

Pallets are extensively used in the loading, stacking and storing of articles, and during such use, the pallets may be subjected to damage, especially as the pallets are picked up by a lifting device, such as a fork lift truck.

In order for wood pallets to be practical, they must be able to resist damage resulting from normal use, engagement with the fork lift truck and from dropping.

SUMMARY OF THE INVENTION

This invention relates to an improved wood pallet design, specifically a pallet having an improved top and bottom deck construction where forces directed inwardly against the decks are distributed and abosrbed. The bottom deck has a relatively large surface area to permit the pallets to be stacked on flowable material. The bottom deck is provided with openings properly spaced to accommodate the wheels of a hand transporter.

Eight-way access by fork lift tongs is provided by using a plurality of plywood spacer blocks between the top and bottom decks. A plurality of nails may be driven into the plywood blocks to increase the strength and rigidity of the pallet without causing the blocks to split.

Furthermore, the assembled pallet is in the form of a truss, and therefore the loads are distributed through the various components in such a way that any defects or weaknesses in any of the components will not deteriorate the total performance of the pallet.

The top deck is preferably formed from a pair of end members, a pair of side members, and a plurality of intermediate load supporting members. The side members each include means forming inwardly facing recesses for receiving the end members. Each of these recesses include an end facing abutment which engages the inside edge of the end members so that inward forces directed inwardly of the end members, such as those experienced when the end is engaged by a fork lift truck, for example, are transmitted into and partially absorbed by the side members. Thus, forces directed at any one component of the pallet are distributed through all components of the pallet.

The end members further include beveled ends which are received against complementary beveled surfaces within the recesses formed in the side members. Both the end and side members are secured to the spacer blocks; however, the side members will support the end members through the interconnection of the beveled surface. Accordingly, since the tongs of the forks normally engage the end members additional strength to the pallet is provided through the use of these beveled joints.

The end members and intermediate members are joined to the side members by corrugated fasteners which are installed from the underneath side of the top deck. They are therefore hidden from view, and since they are not exposed, they will not catch or snag any materials placed on the pallet. The fasteners are installed at an oblique angle and will tighten whenever the end or side members are pushed outwardly (in both the longitudinal and transverse directions) of the pallet.

Corrugated fasteners are also installed adjacent the nail holes to prevent or minimize the effects of splitting of the wood.

The bottom deck is constructed in a similar manner. The area of the bottom deck is made large enough so that the pallet may be supported on flowable material stacked on the pallet beneath it.

The top and bottom decks are separated by means of spacer members including longitudinally extending stringers on which are mounted blocks of plywood. The blocks are formed from a plurality of layers of plywood, and in the preferred embodiment, nine such blocks are used. These blocks permit a plurality of nails to be driven therethrough from both directions. In this manner, longer nails may be used, and this provides increased or improved strength to the pallet. The nine plywood blocks are installed at the corners of the pallet and intermediately of the end and side members to provide for access to the pallet from either the ends, the sides, or diagonally.

Accordingly, it is an object of this invention to provide a wood pallet including a top, load receiving deck, a bottom deck, at least two longitudinally extending stringers, a plurality of spacer blocks attached to said stringers for connecting and separating said top and bottom decks, a plurality of layers of plywood forming each spacer block, a plurality of nails extending into and substantially through each layer of plywood to fasten said layers together into a sturdy block, and a plurality of nails extending through each of said top and bottom decks and into said blocks to fasten said decks and blocks into a completed pallet; to provide a wood pallet of the type described wherein the top deck includes a pair of end members; a pair of side members and a plurality of intermediate load supporting members, said side members each including means forming inwardly facing recesses near the ends thereof for receiving said end members, each recess including an end facing abutment for engaging at least a portion of said end member, whereby inwardly directed forces imposed on said end members, such as those experienced when the pallet is picked up by a fork lift, are transmitted into and partially absorbed by said side member.

It is a further object of this invention to provide a wood pallet of the type described wherein the top deck includes a pair of end members, a pair of side members and a plurality of intermediate load supporting members, said end members each including a beveled surface on the ends thereof which slope downwardly and outwardly, said side members each including means forming inwardly facing recesses adjacent the ends thereof for receiving said end members, each recess including an end facing abutment for engaging at least a portion of said end member, and further including a complementary beveled surface for receiving and engaging said beveled surface of said end member, whereby the interconnection between said end and side members through said beveled surfaces provide additional support to said end member and resistance against the upward forces tending to separate the end members from the spacer blocks which may be exerted against said end members as the pallet is lifted by a lifting device; to provide a wood pallet including corrugated fasteners for securing said side and end members of said top deck together, said fasteners being installed from the underneath side of said top deck at an oblique angle.

These and other objects and advantages of the invention will be apparent from the following description, the accompanying drawings and the appended claims.

DESCRIPTION OF THE PREFERRED EMBODIMENT

Figure 1:
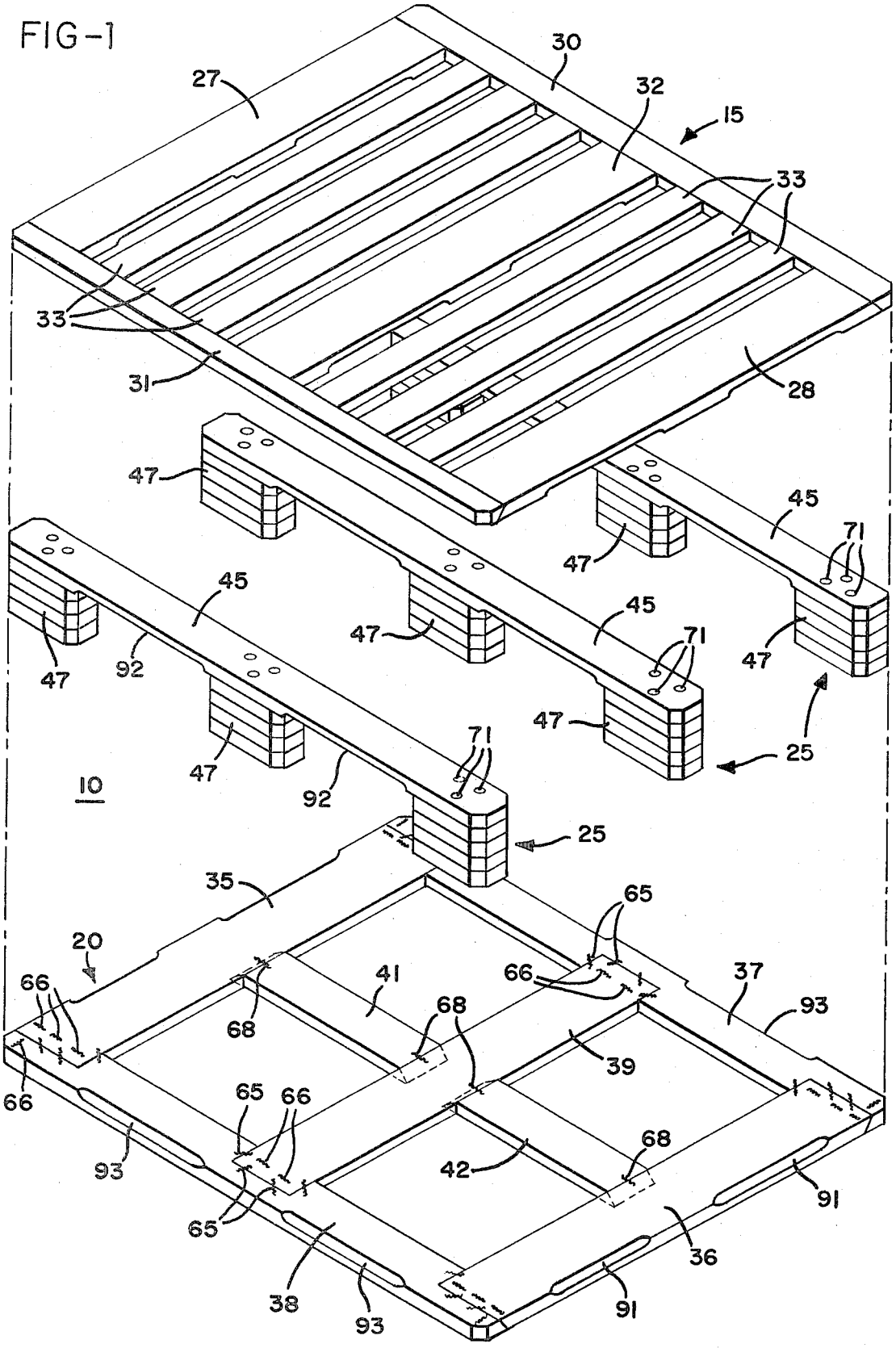
FIG. 1 is an exploded perspective view of the preferred embodiment of a wood pallet constructed according to the invention.
Figure 2:
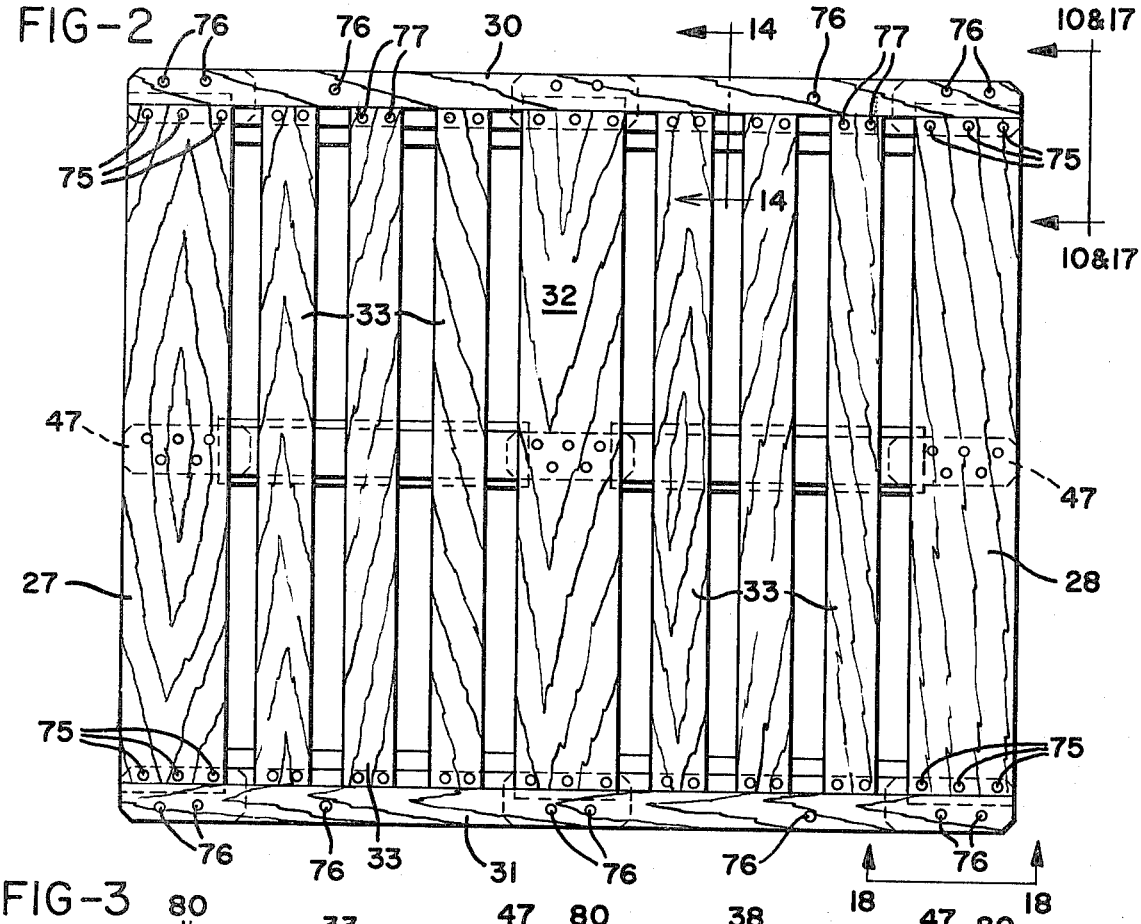
FIG. 2 is a top plan view of the pallet of FIG. 1.
Figure 3:
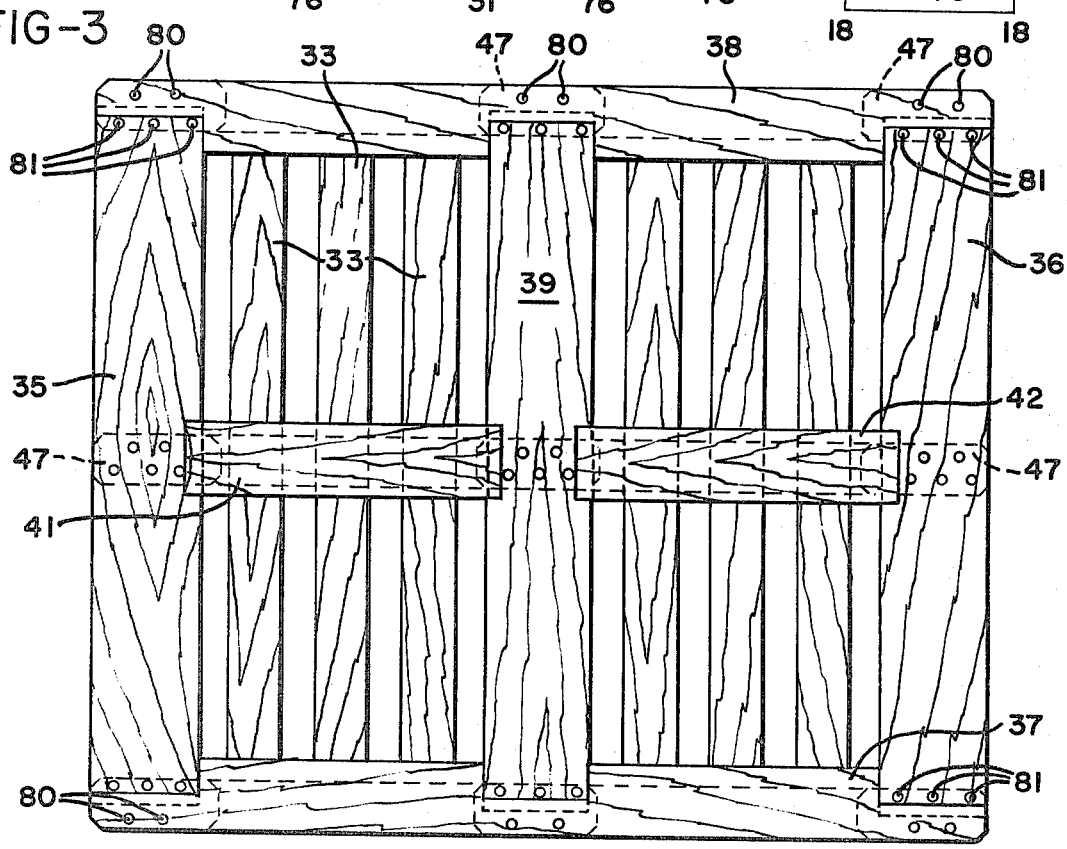
FIG. 3 is a bottom plan view of the pallet.

Referring now to the drawings which show the preferred embodiment of the invention, and particularly to FIGS. 1–3, a wood pallet 10 includes a top deck 15, a bottom deck 20, and a plurality of spacer members 25 for both separating and joining the top and bottom decks into a completed unit.

The top deck 15 includes a pair of end members 27 and 28, a pair of side members 30 and 31, and intermediate load supporting member 32 and a plurality of narrower intermediate load supporting members 33.

The bottom deck 20 includes a pair of end members 35 and 36, a pair of side members 37 and 38, and intermediate, transversely extending member 39 and a pair of smaller, longitudinally extending pieces 41 and 42.

The spacer members 25 each include a longitudinally extending stringer 45 and, in the preferred embodiment, three spacer blocks 47 are attached to each stringer. As shown in FIGS. 2 and 3, spacer blocks 47 are positioned at the corners of the pallet, intermediately of both the side members and the end members, and one spacer block is positioned directly in the center of the pallet.

As shown in FIG. 2, the stringers 45 are wider than the side members 30 and 31, and this permits the intermediate load supporting members of the top decks 30 and 33 to be attached to and supported by the stringers.

Figure 6:
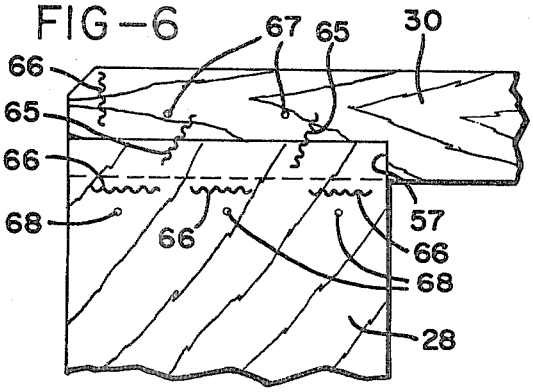
FIG. 6 is an enlarged plan view of a corner portion of the top deck of the pallet as viewed from its underneath side.
Figure 7:
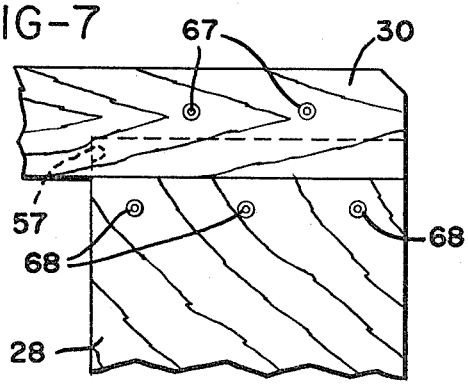
FIG. 7 is an enlarged plan view of a corner portion of the top deck of the pallet as viewed from the top.
Figure 11:
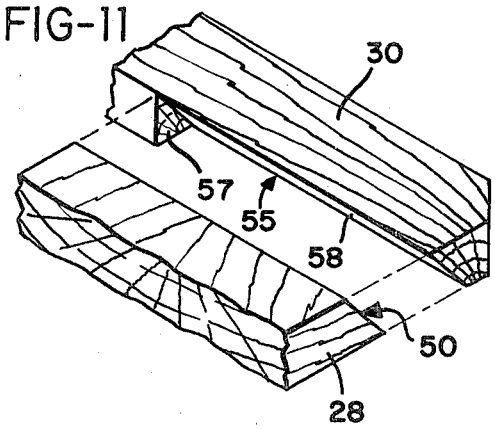
FIG. 11 is an exploded perspective view of a portion of an end and side member showing the beveled surfaces and the end facing abutment.
Figure 12:
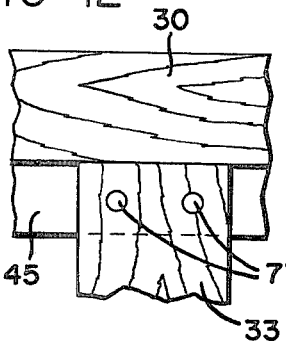
FIG. 12 is an enlarged top plan view of a portion of the top deck showing a side member and an intermediate load supporting member.

Referring to FIGS. 6, 7 and 11, it will be noted that the end members 27 and 28 of the top deck are each provided with beveled ends 50 which slopes outwardly and downwardly of the end member; and the side members 30 and 31 each include means forming a recess 55 adjacent their ends for receiving the end member. Each recess 55 includes an end facing abutment 57 which engages the inside edge of the end member, and also a complementary beveled surface 58 which receives and engages throughout its width the beveled surface 50 of the end member.

As will be explained, the beveled surfaces 50 and 58 provide additional support to the end members, while the abutting surfaces 57 provides supporting for the end members against forces which are directly inwardly thereagainst, such as those which might be experienced when the pallet is picked up by a fork lift.

Figure 10:
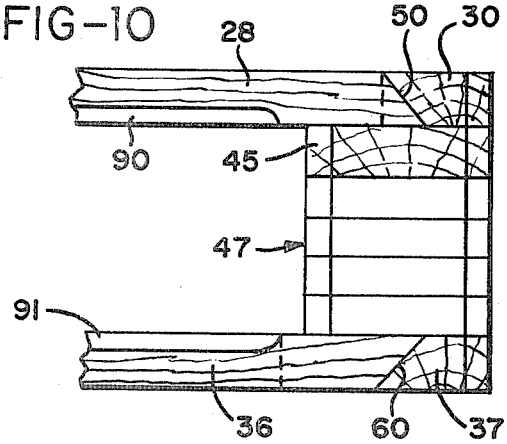
FIG. 10 is an enlarged elevational view of a portion of one corner of the pallet taken along lines 10—10 in FIG. 2.
Figure 17:
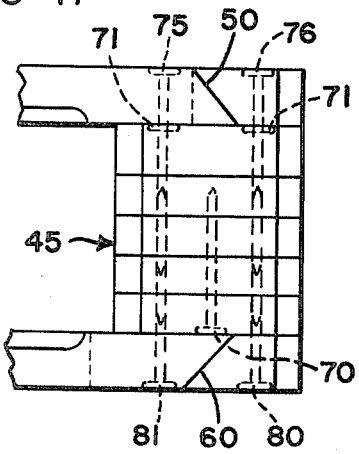
FIG. 17 is an elevational view of a corner of the pallet taken along lines 17—17 in FIG. 2.

The bottom deck 20 also includes beveled surfaces 60 on the end members 35 and 36, as shown in FIGS. 1, 10 and 17, and means forming recesses in the side members 37 and 38 for receiving the end members, the recesses being provided with complementary beveled surfaces. These recesses also include abutting surfaces 62 which help support the end member and provide a means for absorbing those forces imposed on the end members when the pallet is engaged by a fork lift or when the pallet is otherwise subjected to bumbs or collisions with other objects. Also, the intermediate, transverse member 39 includes beveled ends, which are received into recesses formed in the side members.

The sequence in which the pallet is assembled will now be described.

Figure 13:
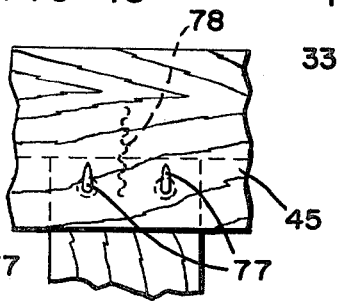
FIG. 13 is a plan view from the underneath side of the top deck showing a portion of the side member and intermediate load supporting member.

The top deck is first assembled by securing the end members to the side members by means of corrugated fasteners 65, shown in FIG. 6. These corrugated fasteners 65 are installed on the underneath side of the top deck, and are thus not visible from the top, nor will they tend to snag any objects which are placed on top of the pallet. The corrugated fasteners are used not only to secure the side and end members, but also the intermediate members load supporting members, as shown in FIG. 13.

Additional corrugated fasteners 66 are installed in both the end and side members between holes 67 and 68, which are predrilled to receive the nails which are used in completing the assembly of the pallet, and the ends of these members to prevent or reduce splitting of the wood.

As shown in FIG. 7, holes 67 and 68 are counterbored to provide recesses for the heads of the nails, thus allowing the heads of the nails to be driven below the surface of the top deck where they are then less likely to catch or snag objects placed on the pallet.

The bottom deck 20 is fabricated in a similar manner, that is, corrugated fasteners 65 and 66 are installed on the inside portion of the bottom deck, that portion which faces inwardly of the pallet. Corrugated fasteners are used on both the end and side pieces as well as the intermediate member 39. The longitudinal pieces 41 and 42 may be secured in place with corrugated fasteners 68.

It should be noted tha the corrugated fasteners 65 are installed at an oblique angle, whereby forces exerted on either the end or side pieces will cause the pieces to tend to move together, thus strengthening the joint.

Figure 8:
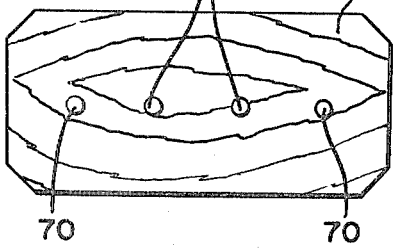
FIG. 8 is a plan view of one of the spacer blocks, as viewed from underneath.
Figure 18:
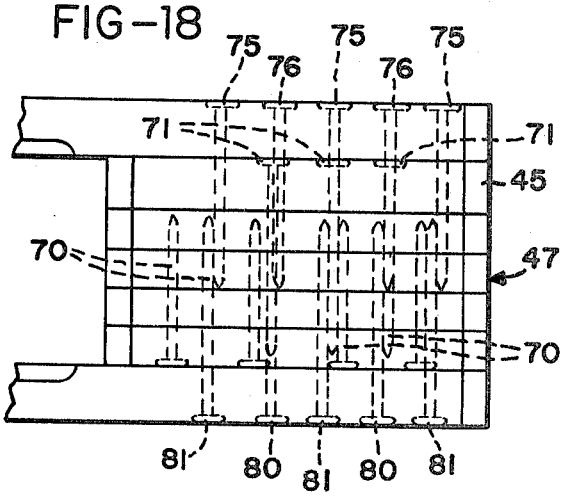
FIG. 18 is a partial side elevational view of the pallet taken along lines 18—18 in FIG. 2.

In the preferred embodiment of the invention, the spacer blocks 47 are formed from a plurality of layers of plywood; four layers are shown. These layers are secured to each other by four nails 70, as shown in FIGS. 8 and 18.

Figure 9:
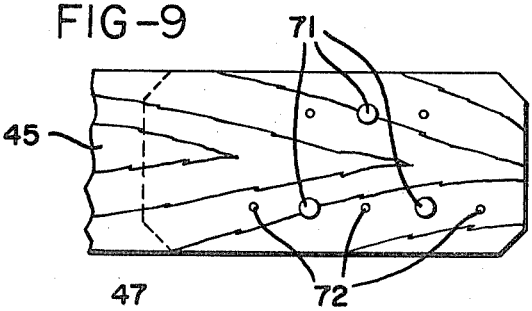
FIG. 9 is a plan view of a portion of one of the stringers with a spacer block, shown in dotted lines, attached thereto.

Next, the spacer blocks 47 are secured to the stringer 45 by means of three nails 71. Since the stringer 45 is preferably made of oak or ash, a plurality of nail holes 72 are predrilled into the block, and the nails 71 are passed through three of these holes. The remaining holes 72 shown in FIG. 9 are aligned with the predrilled holes 67 and 68 shown in FIG. 7 since, in this example, that portion of the stringer 45 shown in FIG. 9 will be placed directly under the corner of the top deck shown in FIG. 7.

The spacer members 25 are then secured to the top deck 27 by means of nails 75, 76 and 77. At the corners, three nails 75 are placed through the predrilled holes 68 in the end member and extend through the predrilled holes 72 in the stringer 45 and into the plywood blocks of the spacer blocks 47, as shown in FIGS. 17 and 18. Two additional nails 76 are driven through predrilled holes 67 in the side members and through holes 72 into the blocks.

Thus, the nails 75 secure the end members 27 and 28 to the stringers 45 while the nails 76 secure the side members 30 and 31 to the stringers. Additional support is provided to the end members by the side members since the upward forces exerted on the end members as the pallet is lifted by fork lift causes the beveled surfaces 50 to transmit some of those forces into the corresponding surfaces 58 in the side members; and thus the end members are restrained by the side members and the means which attach the side members to the stringers.

Similarly, the abutting surfaces 57 of the side members provide support for the end members against forces which are directed inwardly against the end members.

The bottom deck is similarly constructed; and it will be noted that the end members 35 and 36 are set into recesses which are formed deeper into the side members 37 and 38. This provides a longer abutting surface, and is made possible because the side members of the bottom deck are wider than the side members of the top deck.

Figure 14:
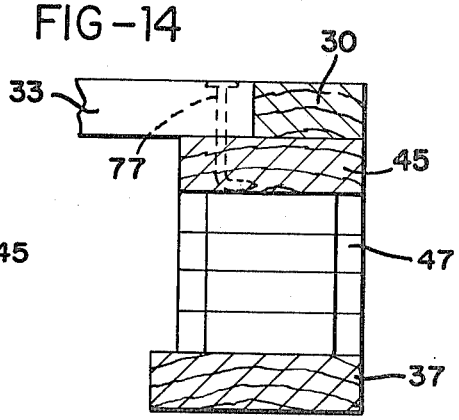
FIG. 14 is a cross-sectional view taken along lines 14—14 in FIG. 2.
Figure 15:
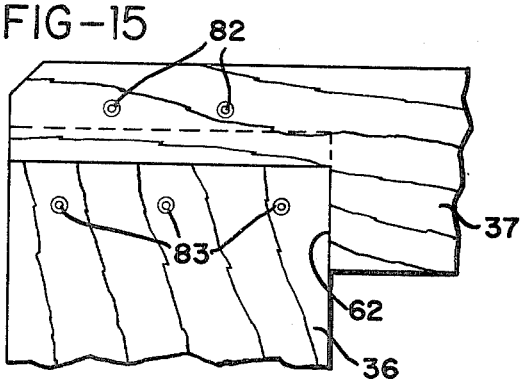
FIG. 15 is an enlarged plan view taken from the underneath side of the pallet showing a portion of one corner of the bottom deck.
Figure 16:
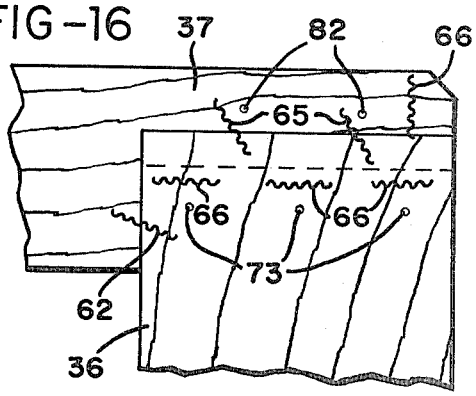
FIG. 16 is a plan view of the same corner shown in FIG. 15 viewed from the interior of the pallet.

Nails 77 are driven through the intermediate load supporting members 32 and 33 and through the stringer 45. The nails 77 are relatively short, and the small portion of the end of the nail which extends through the stringer is clinched, as shown in FIG. 14. The members 32 and 33 are preferably secured to the side members by means of corrugated fasteners 78 when the top deck is initially fabricated.

After the nails 77 are clinched, the bottom deck 20 is installed. Nails 80 and 81 are then driven through predrilled holes 82 and 83 in the bottom deck and into the blocks 47 in the spacer blocks, as illustrated in FIGS. 17 and 18.

It is now apparent that the plywood blocks 47 receive a plurality of nails. Of course, these nails are so positioned that they do not interfere with each other within the blocks, and it may be seen that the length of these nails is such that they overlap in at least one of the blocks. Plywood was chosen since it does not tend to split, even though many nails are driven into it. By having a plurality of nails extending into the blocks, additional shear strength for the fully assembled pallet is provided.

Figure 4:
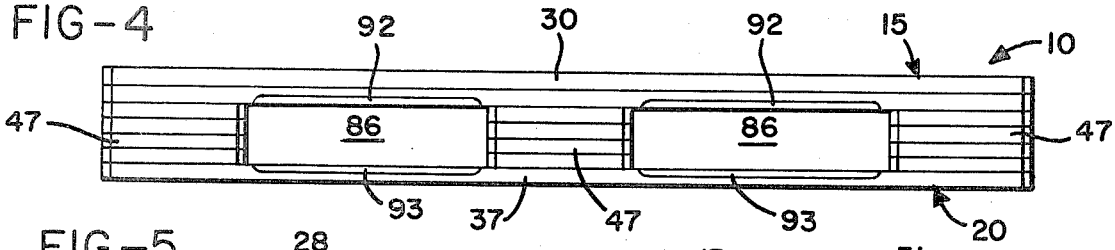
FIG. 4 is a side view of the pallet.
Figure 5:
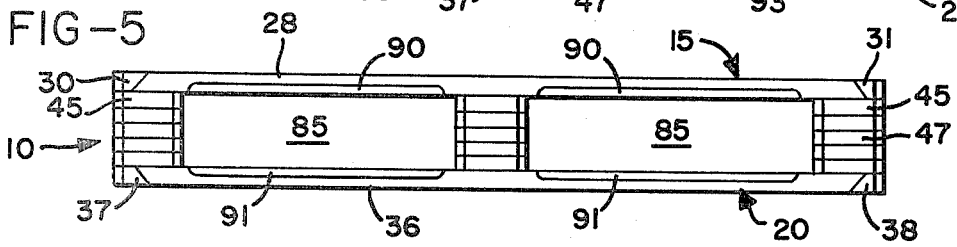
FIG. 5 is an end view of the pallet.

The completely assembled pallet is provided with end openings 85, as shown in FIG. 5, and side openings 86, as shown in FIG. 4. These openings are spaced to accept the tongs of a fork lift, and thus the pallet constructed according to this invention is capable of providing at least a four-way access. Also, since nine spacer blocks 47 are used in the assembling of the pallet, diagonal entry of the fork lift tongs is possible, thus providing an eight-way access to lifting the pallet.

The end members adjacent the openings 85, and the side members adjacent the opening 86 are beveled to facilitate entry of the fork lift tongs into the openings. Thus, the end members 28 and 36 are beveled at 90 and 91; and the stringers 45 are beveled at 92 and 93.

The openings 95 (FIG. 1) in the bottom deck are so positioned as to accept the wheels of a hand transporter.

It will also be appreciated by those familiar with wood pallets that the construction of the pallet described above is that of a truss, and therefore it is capable of supporting heavy loads without significant bending and the consequent loosening of the nails which hold the pallet together.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A wood pallet including a top, load receiving deck;

a bottom deck;

at least two longitudinally extending stringers;

a plurality of spacer blocks attached to at least the corners of and separating said top and bottom decks;

a plurality of layers of playwood forming each spacer block;

a first plurality of nails extending into and substantially through each layer of plywood to fasten said layers together into a sturdy block;

a second plurality of nails extending through said stringers into said blocks, and a third plurality of nails extending through each of said top and bottom decks and into said blocks to fasten said decks and blocks into a completed pallet;

said top deck including a pair of end members; a pair of side members and a plurality of intermediate load supporting members;

said end members each including a beveled surface on the ends thereof which slope downwardly and outwardly;

said side members each including means forming inwardly facing recesses adjacent the ends thereof for receiving said end members, each recess including an end facing abutment for engaging at least a portion of said end member, and further including a complementary beveled surface for receiving and engaging said beveled surface of said end member, whereby the interconnection between said end and side members through said beveled surfaces provide additional support to said end member and resistance against the upward forces tending to separate the end members from the spacer blocks which may be exerted against said end members as the pallet is lifted by a lifting device.

2. The wood pallet of claim 1 further including corrugated fasteners for securing said side and end members of said top deck together, said fasteners being installed from the underneath side of said top deck at an oblique angle.

3. The wood pallet of claim 1 wherein said bottom deck includes a pair of end members, a pair of side members, and a transversely extending intermediate member, each of said end members including a beveled surface on the ends thereof which slope upwardly and outwardly, said side members each including means forming inwardly facing recesses for receiving said end and intermediate members, each said recess including a complementary beveled surface for receiving and engaging said beveled surface of said end and intermediate members, the recesses for said end and intermediate members further including abutments for engaging at least a portion of said members.

* * * * *